US006116522A

United States Patent [19]

Kampichler

[11] Patent Number: 6,116,522

[45] Date of Patent: Sep. 12, 2000

[54] FUEL INJECTION DEVICE

[75] Inventor: Günter Kampichler, Ruhstorf, Germany

[73] Assignee: Motorenfabrik Hatz GmbH & Co. KG, Ruhstorf, Germany

[21] Appl. No.: 09/174,016

[22] Filed: Oct. 16, 1998

Related U.S. Application Data

[63] Continuation of application No. PCT/EP97/01293, Mar. 14, 1997.

[30] Foreign Application Priority Data

Apr. 16, 1996 [DE] Germany ..... 196 14 980

[51] Int. Cl.[7] ..... F02M 59/00

[52] U.S. Cl. ..... 239/533.2; 239/584; 277/607; 277/939

[58] Field of Search ..... 239/533.2–533.11, 239/88, 584; 277/607, 634, 939, 940

[56] References Cited

U.S. PATENT DOCUMENTS 5,205,492 4/1993 Khinchuk .

5,862,995 1/1999 Wu ..... 239/533.2

FOREIGN PATENT DOCUMENTS

| | | |
|---|---|---|
| 685057 | 12/1939 | Germany . |
| 38 19 729 | 6/1988 | Germany . |
| 866 423 | 4/1996 | Germany . |
| 06066222 | 8/1992 | Japan . |
| 1 560 953 | 2/1977 | United Kingdom . |

*Primary Examiner*—Andres Kashnikow
*Assistant Examiner*—Steven J. Ganey
*Attorney, Agent, or Firm*—Helgott & Karas, PC.

[57] ABSTRACT

A fuel injection device for diesel engines, with a nozzle holder (1), the pressure channel (2) of which is connected with the fuel injection pump on the one side, with the nozzle on the other side, comprises a nozzle body (3) which is connected with the nozzle holder (1) by means of a nozzle adjusting nut (10). For sealing purposes, there is an intermediate disk (13) between nozzle holder (1) and nozzle body (3). To seal the high-pressure connection in the region of the pressure channels (2, 4), there is a deformable metal sealing body which rests on a sealing surface and is held in a conical seat (19) in the region of the opening of the pressure channel (2) of the nozzle holder (1).

6 Claims, 5 Drawing Sheets

FUEL INJECTION DEVICE

Figure 1:
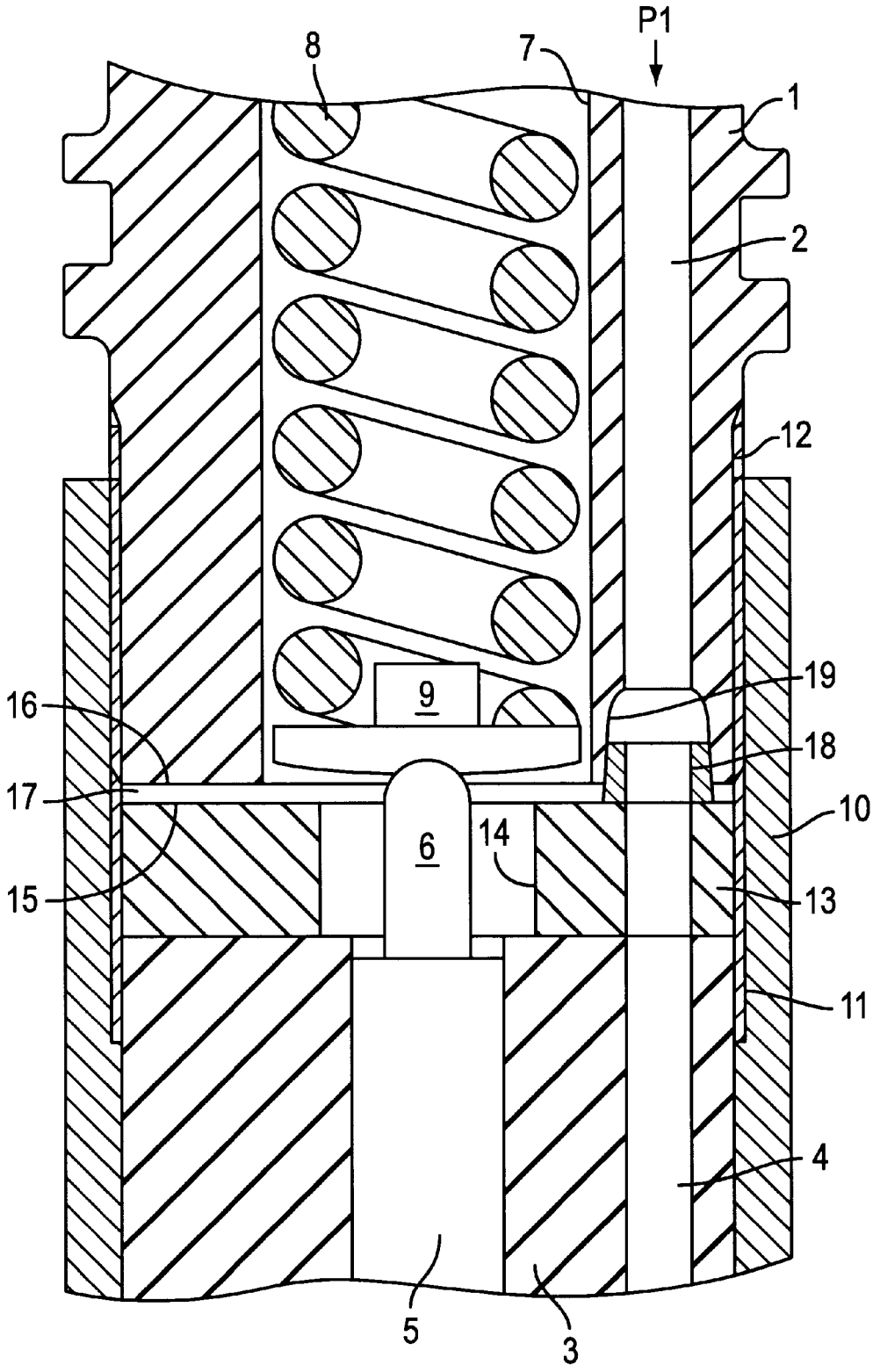

This is a continuation of application Ser. No. PCT/EP97/01293 filed on Mar. 14, 1997.

The invention relates to a fuel injection device for diesel engines, with a nozzle holder, the pressure channel of which is connected with the fuel injection pump on the one side, with the nozzle on the other side, where the nozzle holder is supported relative to a nozzle body which holds the nozzle needle, so that it can move in the lengthwise direction, by means of an intermediate disk, forming a seal. In this connection, a deformable metal hollow cylinder sealing body rests on a sealing surface with one end and increasingly deforms against its seat with increasing tightening of the nozzle adjusting nut which connects the nozzle body with the nozzle holder.

In such fuel injection devices, there is the necessity of sealing the pressure channel in the transition region between the nozzle holder and the nozzle body, so that an exit of fuel into the spring space and through the thread of the nozzle adjusting nut is reliably prevented. In known embodiments, this is achieved in that the faces of the nozzle holder and the nozzle body which face each other, as well as both faces of an intermediate disk arranged between the nozzle holder and the nozzle body each have a microfinished surface which is hardened, ground flat, and lapped by means of complicated finishing processes. In this connection, the pressure channel in the nozzle holder is adjacent to a corresponding bore in the intermediate disk, the bore of which in turn is adjacent to a corresponding pressure channel in the nozzle body, which leads to the nozzle. By having the surfaces lapped exactly parallel in the same plane on both sides of the intermediate disk as well as on the adjacent faces of the nozzle holder and the nozzle body, a reliable seal is achieved, but a significant surface finishing effort is required. Such a fuel injection device is described in JP patent 6-66222.

In contrast to this, the task on which the present invention is based is to achieve a seal of the pressure channel on the one side and the interior of the nozzle body and the nozzle holder on the other side, to prevent exit of fuel through the thread of the nozzle adjusting nut, which seal can be implemented with less effort.

This task is accomplished, according to the invention, by the characteristics of claim 1. Although the face of the nozzle holder is correspondingly lifted from the related top of the intermediate disk, since such face forms an angle of a few degrees with the top, the sealing body ensures a seal connection of the pressure channel in the nozzle holder with the intermediate disk, i.e. with the nozzle body, where the conical sealing surfaces result in self-centering of the sealing body and therefore it is guaranteed that the latter will form a closure and a seal even under high-pressure conditions. In this manner, peak pressures of up to 1000 bar can be managed. Furthermore, additional sealing measures to seal the needle closing spring frame are unnecessary, because of the concentric sealing edge.

According to a first preferred embodiment, it is provided that the sealing body is structured as a sealing cone with a conical outside shape corresponding to the conical seat in the nozzle holder, and that the counter-sealing surface on which the sealing cone rests is formed by the top of the intermediate disk.

The sealing cone accomplishes the partial task of connecting the pressure channel to the intermediate disk on the high-pressure side, forming a seal, without microfinishing of the facing face of the nozzle holder being required.

In this connection, the deformability of the sealing cone is promoted in that the sealing cone is sized to be shorter in the axial direction than the seat in which it is held.

According to a second embodiment, it is provided that the sealing body is structured as a sealing ring with two opposite conical segments on the outside, where one segment is structured in accordance with the conical seat in the nozzle holder, while the other segment is structured in accordance with a conically widened opening of the pressure channel bore in the intermediate disk. In the case of such a sealing ring with two conical segments, the sealing effect achieved is particularly good and permanent. The same holds true for a third embodiment according to the characteristic of claim 5, in which the intermediate disk is bridged, in a way, by means of a small sealing tube which is inserted through a support bore of the intermediate disk; this means that here the high-pressure-side seal is produced directly between the two openings of the pressure channel which face one another, one in the nozzle holder, the other in the nozzle body.

Figure 2:
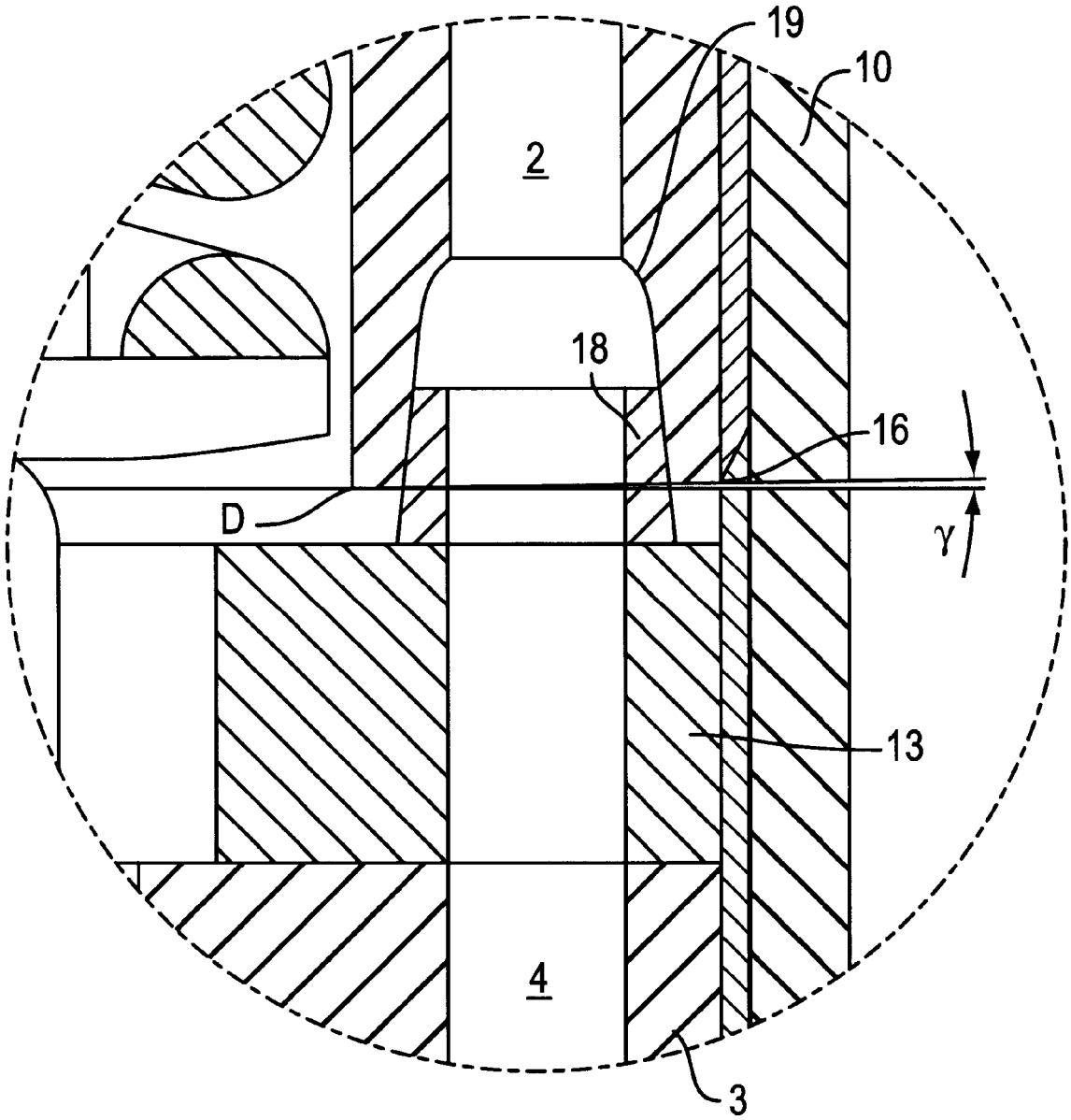
Figure 3:
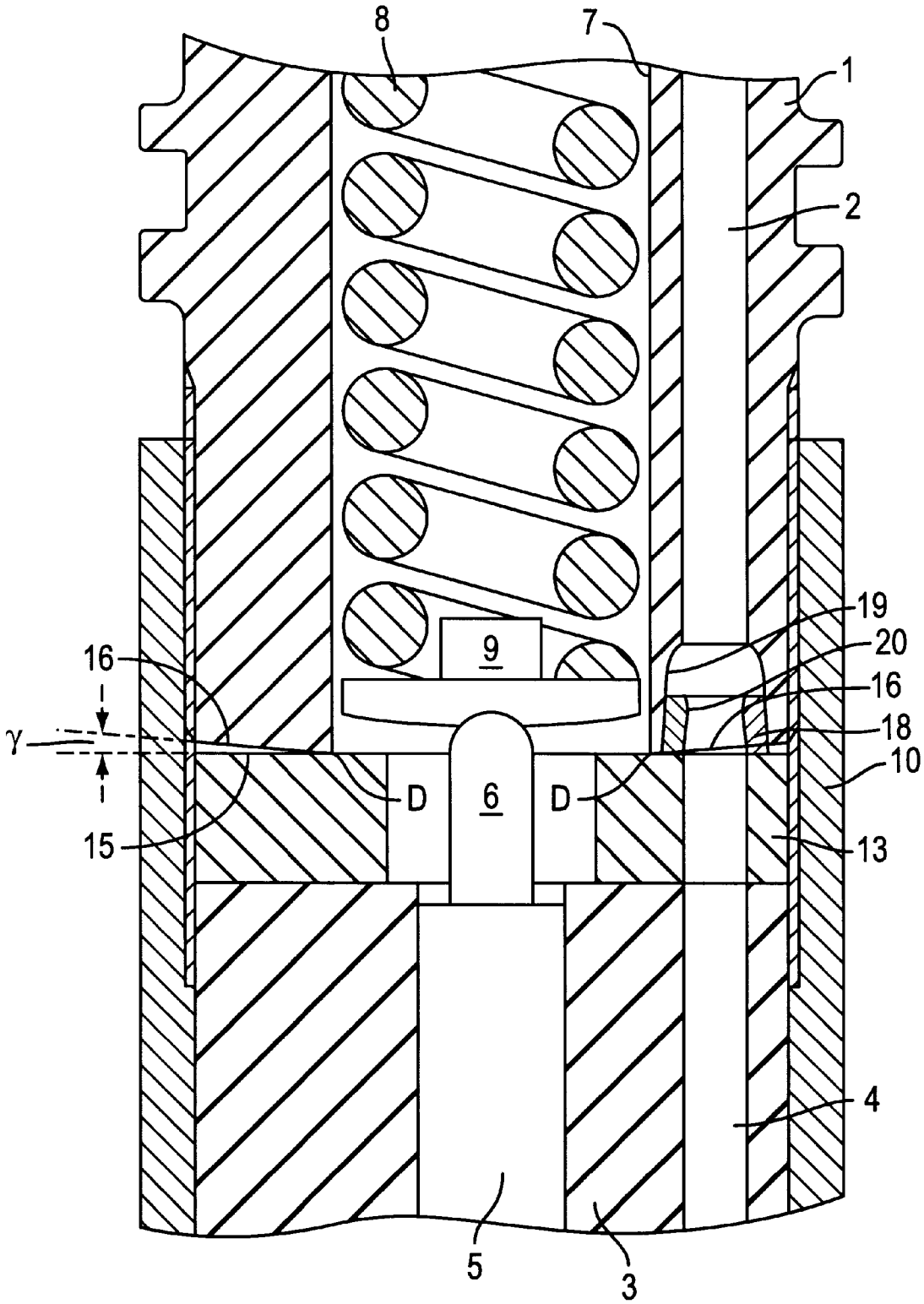
Figure 4:
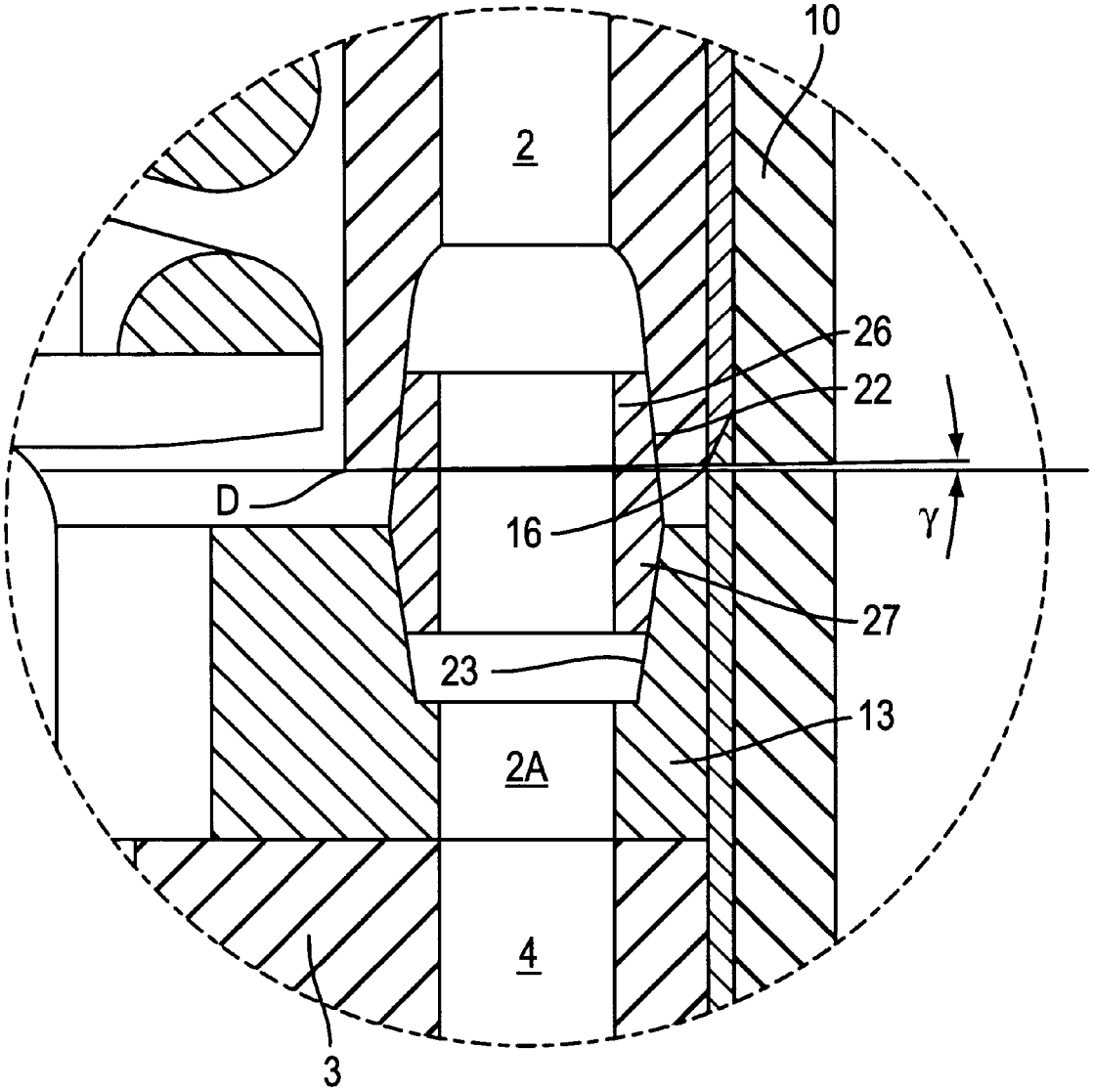
Figure 5:
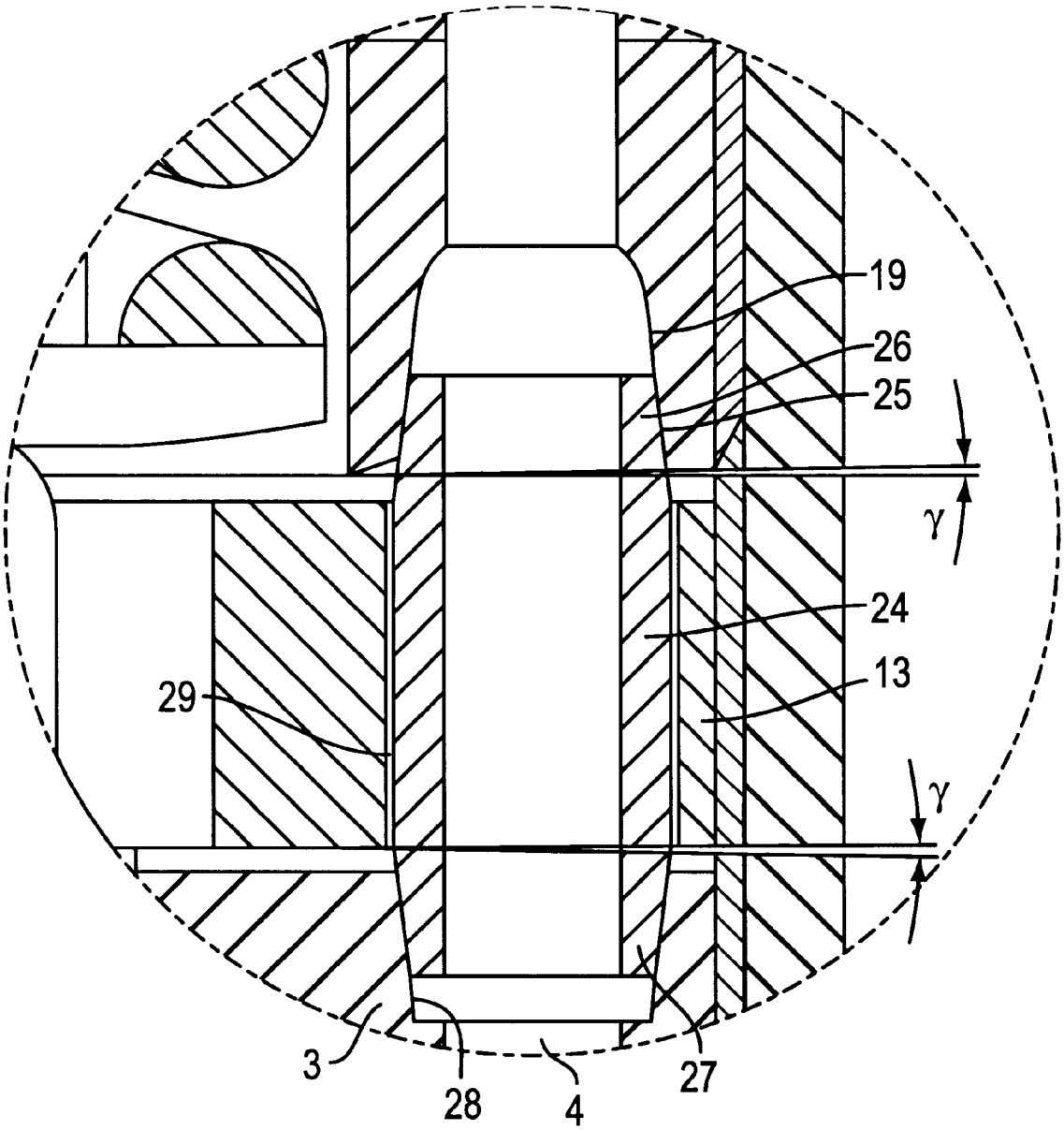

In the following, exemplary embodiments of the invention will be explained on the basis of the drawings. These show:

FIG. 1 a lengthwise cross-section through nozzle holder/nozzle body before the nozzle adjusting nut is completely tightened, FIG. 2 an enlarged section of FIG. 1 in the region of the pressure channel seal, FIG. 3 a lengthwise cross-section according to FIG. 1 after the nozzle adjusting nut has been completely tightened, and FIGS. 4 and 5 a variant of FIG. 2 in each instance.

The fuel injection device according to FIG. 1 to 3 comprises a nozzle holder 1 with a pressure channel 2, in which the fuel is supplied in the direction of the arrow P1 by the fuel injection pump, not shown, as well as a nozzle body 3, which is also provided with a pressure channel 4, which continues the pressure channel 2 of the nozzle holder 1 via a high-pressure connection which will still be described in greater detail. The nozzle needle 5, the interior needle end 6 of which is structured in ball shape, sits in a center bore in nozzle body 3. The needle end 6 of the nozzle needle 5 is pre-stressed in the direction of the nozzle by a pressure spring 8, which is arranged in a center bore 7 of the nozzle holder 1. It exerts a force acting on the needle end 6 in the closing direction, in that it rests on a pressure bolt 9 which sits on the ball-shaped needle end 6 of the nozzle needle 5.

Nozzle body 3 and nozzle holder 1 are tightened together by a nozzle adjusting nut 10, which is screwed onto an outside thread 12 of the nozzle holder 1 by means of an inside thread 11.

The high-pressure connection between nozzle holder 1 and nozzle body 3 is produced by means of an intermediate disk 13, the two opposite faces of which are microfinished by means of hardening, grinding, and lapping. The needle end 6 projects through a central bore 14 of the intermediate disk 13.

According to FIG. 1, the nozzle adjusting nut 10 has not yet been fully tightened, so that a gap 17 is formed between the top 15 of the intermediate disk 13 and the related face 16 of the nozzle holder 1. This gap 17 is bridged by a sealing cone 18 made of a steel alloy with limited deformation properties, for example made of free cutting steel. The sealing cone 18 possesses a conical mantle surface which widens toward the intermediate disk 13, with which it projects into a corresponding conical seat 19 in the opening region of the pressure channel 2 of the nozzle holder 1.

If the nozzle adjusting nut 10 is tightened further, the sealing cone 18 deforms toward the inside, as shown in FIG. 3, forming an end bead 20, until it finally is held completely within the inside of the seat 19. In the sealing position shown in FIG. 3, the sealing cone forms a seal which is tight against the high pressure in pressure channel 2, with the seat 19 on the one side and the top 15 of the intermediate disk 13 on the other side.

Sealing of the high-pressure region relative to the low-pressure region takes place in that, as shown in FIG. 2 on a larger scale, a sealing edge runs concentrically through the location D which coincides with the wall of the needle closing spring space, via the face 16 of the nozzle holder 1, in such a way that the sealing edge coincides with the center bore 7 of the nozzle holder 1, on its face 16. This makes any additional sealing measures to seal the needle closing spring space unnecessary. The location D therefore forms the vertex for the angle γ which amounts to between 0.5° and 3.0°, which defines face 16 of the nozzle holder 1. The sealing edge results in an additional barrier between the high-pressure section formed by the two pressure channels 2, 4, on the one side, and the low-pressure section which is delimited by the central interior spaces in the nozzle holder 1 and the nozzle body 3, on the other side, and this additional barrier increases the sealing effect under the tightening effect of the nozzle adjusting nut 10.

It is very important for the sealing effect of the sealing cone 18 that it can position itself in the sense of centering as the nozzle adjusting nut 10 is screwed on more tightly, while it deforms slightly, as shown in FIG. 3.

FIGS. 4 and 5 each show a variant of the high-pressure-side pressure channel seal in an enlarged section according to FIG. 2. In FIG. 4, the deviation as compared with FIG. 2 is that the sealing cone 18 is replaced with a sealing ring 22, which is essentially composed of two opposite conical segments 26, 27, on the outside, the cone surfaces of which narrow toward the end of the sealing ring 22 in each instance. While the top segment 26 is held in the bottom end of the pressure channel 2, as was described in connection with FIG. 2, the bottom segment 27 enters into a corresponding conically widened opening 23 of the pressure channel bore 2*a* of the intermediate disk 13, on its top 15. The sealing effect is further improved by the enlargement of the sealing surfaces achieved in this way, as compared with FIG. 3. The same holds true for the variant according to FIG. 5. There, a small sealing tube 25 is used, which has two conical segments 26, 27 at its two ends, like the sealing ring 22 (FIG. 4), which are at the ends of a hollow cylinder center segment 24, which is tightly surrounded by a support bore 29 of the intermediate disk 13. While the top segment 26 is held in the conical seat 19 of the pressure channel 2, as was described for FIG. 2, the bottom segment 27 enters into a corresponding conically widened opening 28 of the pressure channel 4 of the nozzle body 3.

What is claimed is:

1. Fuel injection device for diesel engines comprising:

(a) a nozzle holder (1) having a face (16), a center bore (7) and a pressure spring (8), (b) a nozzle body (3) having a nozzle needle (5), (c) a pressure channel (2, 4) coupled to a fuel injection pump and extending from and through said nozzle holder (1) and nozzle body (3), (d) said nozzle holder (1) being supported relative to said nozzle body (3) so that said nozzle holder (1) is movable in the lengthwise direction into sealing engagement with said nozzle body (3) by means of an intermediate disk (13) having a top (15), and (e) a deformable metal hollow cylinder sealing body (18) extending between a counter-sealing surface and a conical seat (19) and adapted for deformation against seat (19) with increasing tightening of a nozzle adjusting nut (10) which connects the nozzle body (3) with the nozzle holder (1), (f) wherein said sealing body (18) engages said conical seat (19) in the nozzle holder (1) which widens toward the opening of the pressure channel (2) which faces the nozzle body (3), and (g) the face (16) of the nozzle holder (1) is formed in the shape of a truncated cone, whereby the face (16) forms a slight conical angle (γ) with the top (15) of the intermediate disk (13), causing a concentric sealing edge (D) to be formed around a central interior space of the nozzle holder (1).

2. Fuel injection device according to claim 1, wherein the sealing body is structured as a sealing cone (18) with a conical outside shape corresponding to the conical seat (19) in the nozzle holder (1), and that the counter-sealing surface on which the sealing cone (18) rests is formed by the top (15) of the intermediate disk (13).

3. Fuel injection device according to claim 2, wherein the sealing cone (18) is sized to be shorter in the axial direction than the seat (19) in which said cone (18) is held.

4. Fuel injection device according to claim 1, wherein the sealing body is structured as a sealing ring (22) with two opposite conical segments (26, 27) on the outside, where one segment (26) is structured in accordance with the conical seat (19) in the nozzle holder (1), while the other segment (27) is structured in accordance with a conically widened opening (23) of the pressure channel bore (2*a*) in the intermediate disk (13), and a counter-sealing surface is formed by the opening (23) of the pressure channel (2*a*) of the intermediate disk (13).

5. Fuel injection device according to claim 1, wherein the sealing body is structured as a small sealing tube (25) with two opposite conical segments (26, 27) on the outside, at opposite ends of a hollow cylinder center segment (24), where one segment (26) is structured in accordance with the conical seat (19) in the nozzle holder (1), while the other segment (27) is structured in accordance with a conically widened opening (28) of the pressure channel (4) of the nozzle body (3), and where the small sealing tube (25) is tightly surrounded by a corresponding support bore (29) of the intermediate disk (13), with said center segment (24), and a countersealing surface is formed by the opening (28) of the pressure channel (4) of the nozzle body (3).

6. Fuel injection device according to claim 1, wherein the diameter of the circle described by the concentric sealing edge is equal to that of the center bore of the nozzle holder (1) which holds the pressure spring (8).

* * * * *